US006386760B1

(12) United States Patent
Tomic

(10) Patent No.: US 6,386,760 B1
(45) Date of Patent: May 14, 2002

(54) SLIDER RECLOSABLE BAGS WITH DUAL TAMPER-EVIDENT FEATURES

(75) Inventor: Mladomir Tomic, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 3 days.

(21) Appl. No.: 09/591,961

(22) Filed: Jun. 12, 2000

(51) Int. Cl.[7] ..... B65D 33/14

(52) U.S. Cl. ..... 383/5; 383/64; 383/203; 383/207; 383/493; 383/212; 383/214; 383/264

(58) Field of Search ..... 383/61, 63, 64, 383/5, 203, 202, 207, 66; 493/212, 214, 213, 264

(56) References Cited

U.S. PATENT DOCUMENTS

| | | | | |
|---|---|---|---|---|
| 3,181,583 A | | 5/1965 | Lingenfelter | |
| 4,285,376 A | | 8/1981 | Ausnit | |
| 4,925,316 A | * | 5/1990 | Van Erden et al. | 383/61 |
| 5,024,537 A | | 6/1991 | Tilman | |
| 5,033,868 A | | 7/1991 | Peppiatt | |
| 5,121,997 A | | 6/1992 | La Pierre et al. | |
| 5,211,482 A | | 5/1993 | Tilman | |
| 5,601,368 A | * | 2/1997 | Bodolay et al. | 383/5 |
| 5,660,479 A | * | 8/1997 | May et al. | 383/61 X |
| 5,672,009 A | * | 9/1997 | Malin | 383/61 X |
| 5,711,609 A | * | 1/1998 | Simonsen | 383/63 |
| 5,827,163 A | * | 10/1998 | Kettner | 493/213 X |
| 5,875,611 A | * | 3/1999 | Plourde | 493/213 X |
| 5,964,532 A | | 10/1999 | St. Phillips et al. | |
| 6,030,122 A | * | 2/2000 | Ramsey et al. | 383/61 |
| 6,079,878 A | * | 6/2000 | Yeager | 383/203 |
| 6,088,887 A | * | 7/2000 | Bois | |
| 6,251,209 B1 | * | 6/2001 | Johnson | 383/63 X |

FOREIGN PATENT DOCUMENTS

| | | |
|---|---|---|
| EP | 0528721 | 2/1993 |

* cited by examiner

*Primary Examiner*—Lee Young
*Assistant Examiner*—Robin A. Hylton
(74) *Attorney, Agent, or Firm*—Tracy D. Beiriger

(57) ABSTRACT

A flexible reclosable package includes a package surrounding wall. The surrounding wall includes a first side panel and a second side panel opposite the first side panel. A reclosable zipper is mounted along the mouth for selective opening and closing of the package. The reclosable zipper includes a first and second closure member with the second side panel extending between them. The second side member includes a tear region having lower shear strength than remaining portions of the second side panel. Methods of operation and manufacture are described.

19 Claims, 9 Drawing Sheets

SLIDER RECLOSABLE BAGS WITH DUAL TAMPER-EVIDENT FEATURES

FIELD OF THE DISCLOSURE

This disclosure generally relates to closure arrangements for polymer packages, such as plastic bags. In particular, this disclosure describes reclosable packages with tamper-evident structures.

BACKGROUND

Form, fill, and seal technology is known in the packaging industry as a method to package consumable goods. Consumable goods that are not used completely when the package is initially opened rely on a zipper closure to reclose the package and keep the remaining contents fresh. Examples of consumable goods that are often packaged in packages with a zipper closure include potting soil, fertilizer, pet food, dog biscuits, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure or seal, to notify whether access has been gained to the zipper closure, is desired. Improvements in these types of packages are desirable.

SUMMARY OF THE DISCLOSURE

The present disclosure relates to a reclosable zipper combined with a flexible package to create a tamper-evident flexible package. The flexible package includes a package surrounding wall defining an interior and having a mouth. The surrounding wall includes two opposing side panels. A reclosable zipper is provided along the mouth for selective opening and closing of the mouth. The reclosable zipper is mounted on the package and includes a first and second closure profile with a side panel extending between the first and second closure profiles. The reclosable zipper includes a tear region located between the first and second closure profiles. The tear region has a lower shear strength than the remaining portions of the second side panel.

Methods of operation are described. Methods include a step of providing a flexible package with a reclosable zipper. The flexible package has a surrounding wall including a first side panel and a second side panel opposite the first side panel. A reclosable zipper is mounted along the mouth for selective opening and closing of the package. The reclosable zipper includes a first and second closure member with the second side panel extending between them. The second side member includes a tear region having lower shear strength than remaining portions of the second side panel. The method further includes a step of penetrating the tear region.

Methods of manufacturing are described. Methods include a step of providing a zipper closure with a first closure profile and a second closure profile. A first side panel is attached to the first closure profile. A second side panel is attached to the first closure profile and the second closure profile to provide a tamper-evident structure. A slider device is operable mounted onto the zipper closure to provide the reclosable package. The slider device is constructed and arranged for interlocking the first closure profile with the second closure profile when the slider device is moved in a first direction, and for disengaging the first closure profile from the second closure profile when the slider device is moved in a second opposite direction.

DETAILED DESCRIPTION

Flexible Reclosable Package

Figure 1:
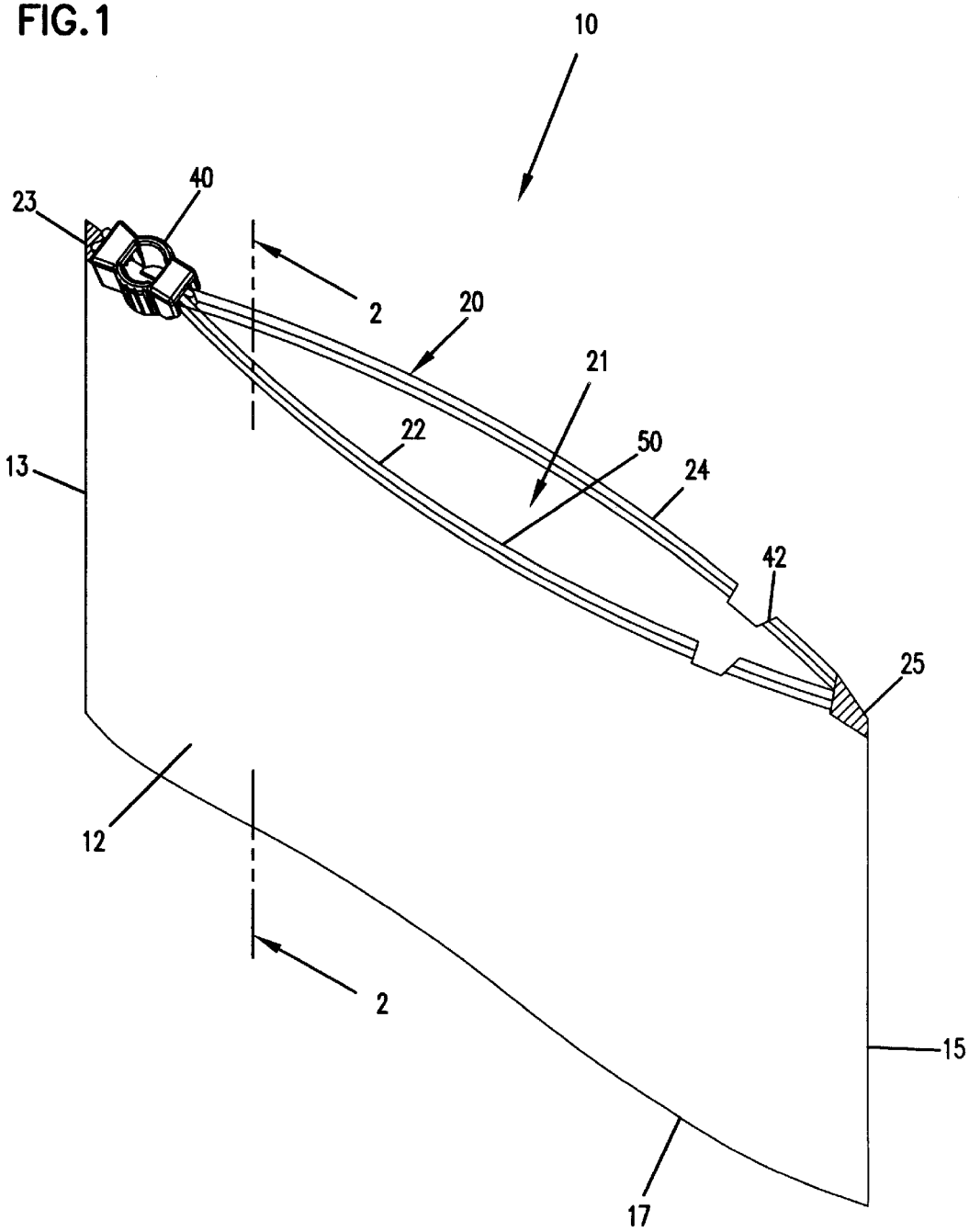
FIG. 1 is a perspective view of a flexible, reclosable package.
Figure 2A:
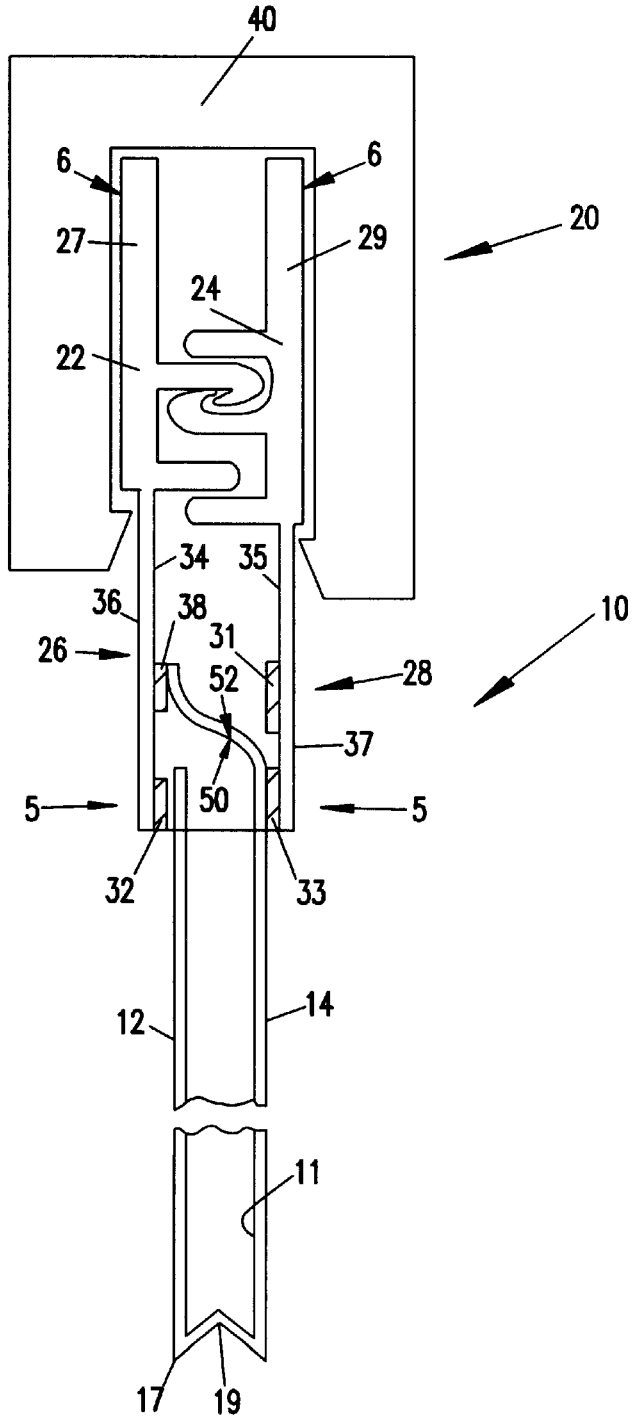
FIG. 2*a* is a schematic, cross-sectional view of an flexible, reclosable package, similar to that depicted in FIG. 1, taken along line 2—2 of FIG. 1.
Figure 2B:
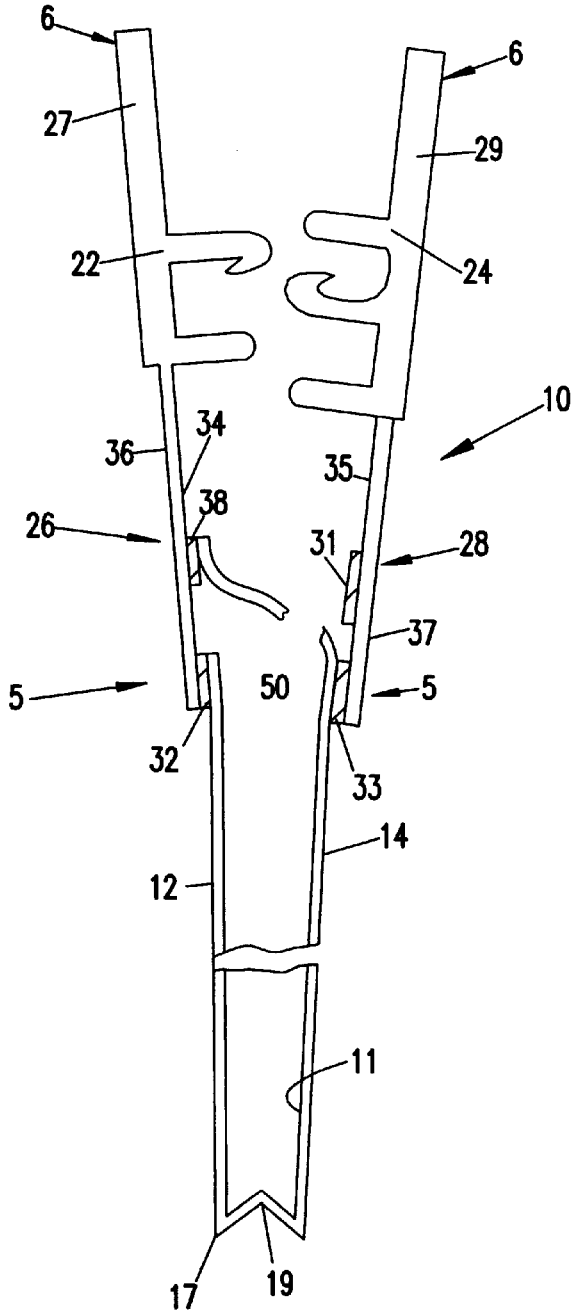
FIG. 2*b* is a schematic, cross-sectional view of a flexible, reclosable package, with the tamper-evident structure breached, similar to that depicted in FIG. 1, taken along line 2—2 of FIG. 1.

A flexible, reclosable package 10 is shown in FIGS. 1 and 2*a*. Package 10 has opposing side panels 12 and 14 (FIG. 2*a*) defining an interior 11 (FIG. 2*a*); side panels 12, 14 are generally polymeric film. Package 10 includes opposite side edges 13, 15 and bottom edge 17. The distance between first side edge 13 and second side edge 15 is the length of package 10. Preferably, each of first side edge 13 and second side edge 15 is a heat seal between side panels 12, 14, which is formed when a single sheet of film is folded to form the two side panels. Bottom edge 17 can be a fold line formed when a single piece of film is folded, or bottom edge 17 can be a seal, created by the application of heat and pressure to side panels 12, 14. Bottom edge 17 can include a gusset 19, shown in FIG. 2*a* and FIG. 4*a*. Gussets are known for providing packages with "stand-up" features.

Throughout this disclosure, the side of the package having the bottom edge 17 will be referred to as the "bottom" of the package, and the side having the zipper closure 20 will be referred to as the "top" of the bag. It is understood that package 10 can be oriented so that bottom edge 17 is not positioned below zipper closure 20; nevertheless, the reference for "top" at the zipper closure remains.

A mouth 21 provides access to interior 11 of package 10 along the top of the package. A zipper closure 20 has mating or closure profiles 22, 24 to open and close (unseal and reseal) the mouth 21 of package 10. Preferably, the zipper closure 20 extends across the length of package 10. Preferably, the zipper closure 20 extends from first side edge 13 to second side edge 15. Preferably, in some arrangements, at each of first and second side edges 13, 15 is a crush point 23, 25. Crush points 23, 25 are areas where zipper closure 20 has been sealed to side panels 12, 14. The zipper closure 20 can include a variety of configurations and structures. Zipper closure 20 can be configured in any known manner, for example, such as disclosed in U.S. Pat. Nos. 4,240,241; 4,246,288; and 4,437,293; each of which is incorporated by reference herein.

Zipper Closure

Zipper closure 20, FIG. 2*a*, FIG. 2*b*, FIG. 3*a*, FIG. 4*a*, FIG. 5*a*, and FIG. 5*b* has a first closure profile 22 and a second closure profile 24 that engage and disengage, as appropriate, to open and close package 10. Zipper closure 20 generally extends from a first side edge 13 to a second side edge 15 at mouth 21 (FIG. 1). First and second closure profiles 22, 24 of zipper closure 20 are attached to side panels 12, 14, respectively, by sealing flanges 26, 28 as will be described in detail below. Sealing flanges 26, 28 are located at a first end 5 of the closure profiles 22, 24. Distal flanges 27, 29 are located at a second end 6 of the closure profiles 22, 24. The zipper closure 20 is preferably made from polyethylene, polypropylene, or copolymers of polyethylene and polypropylene. Especially preferred materials are linear low density polyethylene, low density polyethylene and linear and low density polyethylene/polypropylene mixtures. In preferred arrangements, the sealing flange 26, 28 is from 1 to 10 mil thick and preferably between 4 to 8 mil thick. In preferred arrangements, the distal flange 27, 9 is from 1 to 15 mil thick and preferably between 4 to 10 mil thick.

Attachment Arrangement

In preferred embodiments, the package 10 will include an attachment arrangement for securing the zipper closure 20 to the side panels 12, 14 in a particular, preferred manner. In the particular embodiment illustrated in FIG. 2*a*, the attachment arrangement utilizes the sealing flanges 26, 28. In general, first closure sealing flange 26 has an inner surface 34 and an outer surface 36. Second closure sealing flange 28 has an inner surface 35 and an outer surface 37. FIG. 2*a* shows a first sealing layer 32 disposed on the inner surface 34 of the first sealing flange 26. A second sealing layer 33 is disposed on the inner surface 35 of the second sealing flange 28. A third sealing layer 38 is disposed on the inner surface 34 of the first sealing flange 26. The third sealing layer 38 can be spaced apart from the first sealing layer 32 and between the first sealing layer 32 and the main body of the first closure profile 22. A non-sealing layer 31 may be disposed on the inner surface 35 of the second closure sealing flange 28. The non-sealing layer 31 is preferably located directly opposite from the third sealing layer 38. A first side panel 12 of the flexible package 10 is attached to the first sealing layer 32. A second side panel 14 of the flexible package 10 is attached to the second sealing layer 33 and the third sealing layer 38. The second side panel 14 extends between and is attached to the first and second sealing flange 24, 26. A tear region is located between the first and second sealing flange 26, 28 and is detailed below. This embodiment has side panels 12, 14 that extend on the sealing flanges 26, 28 at dissimilar heights. The first side panel 12 extends to the top of the first sealing layer 32. In contrast, the second side panel 14 extends to the top of the third sealing layer 38. Thus, the area between the first sealing layer 32 and the third sealing layer 38 on the first sealing flange does not have a side panel spanning the sear. This type of arrangement is useful for applications that do not require a hermetic seal, since hermetic sealing material is preferably incorporated on the polymer side panels 12, 14.

Figure 3A:
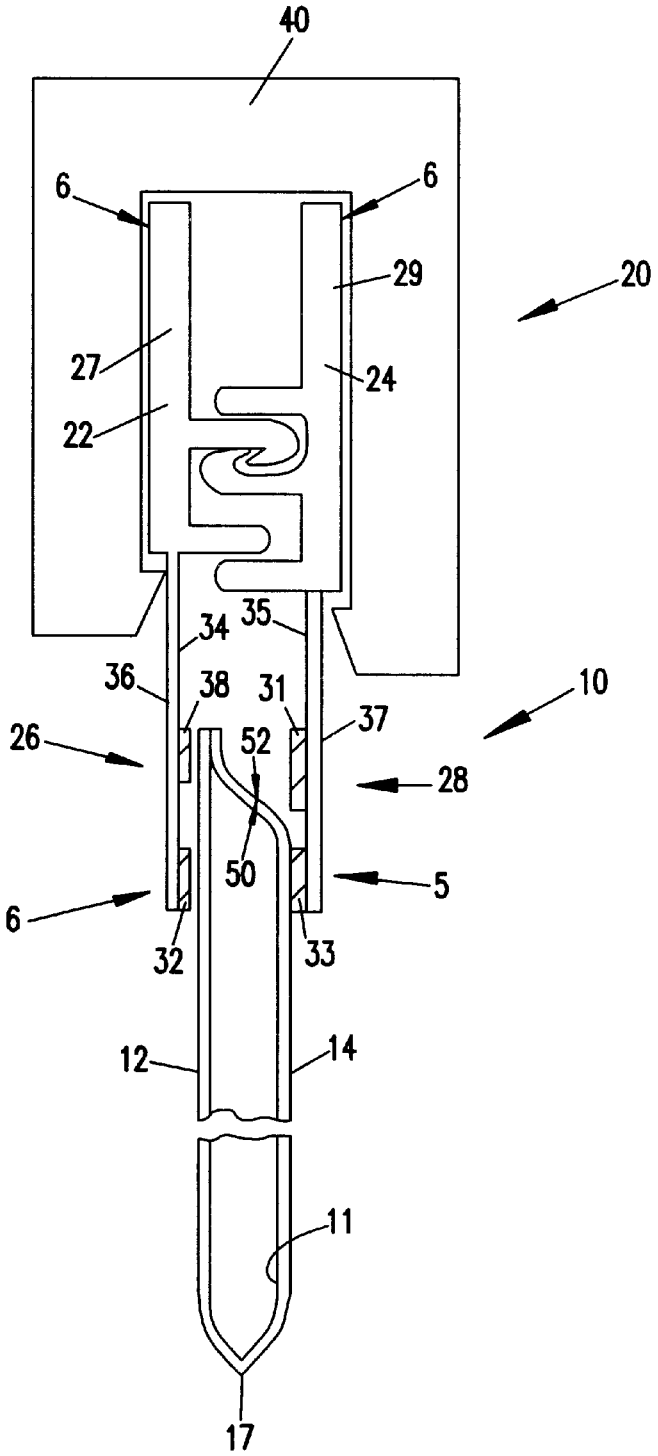
FIG. 3*a* is a schematic, cross-sectional view of a second embodiment of a flexible, reclosable package, analogous to the view of the package of FIG. 2*a;*
Figure 3B:
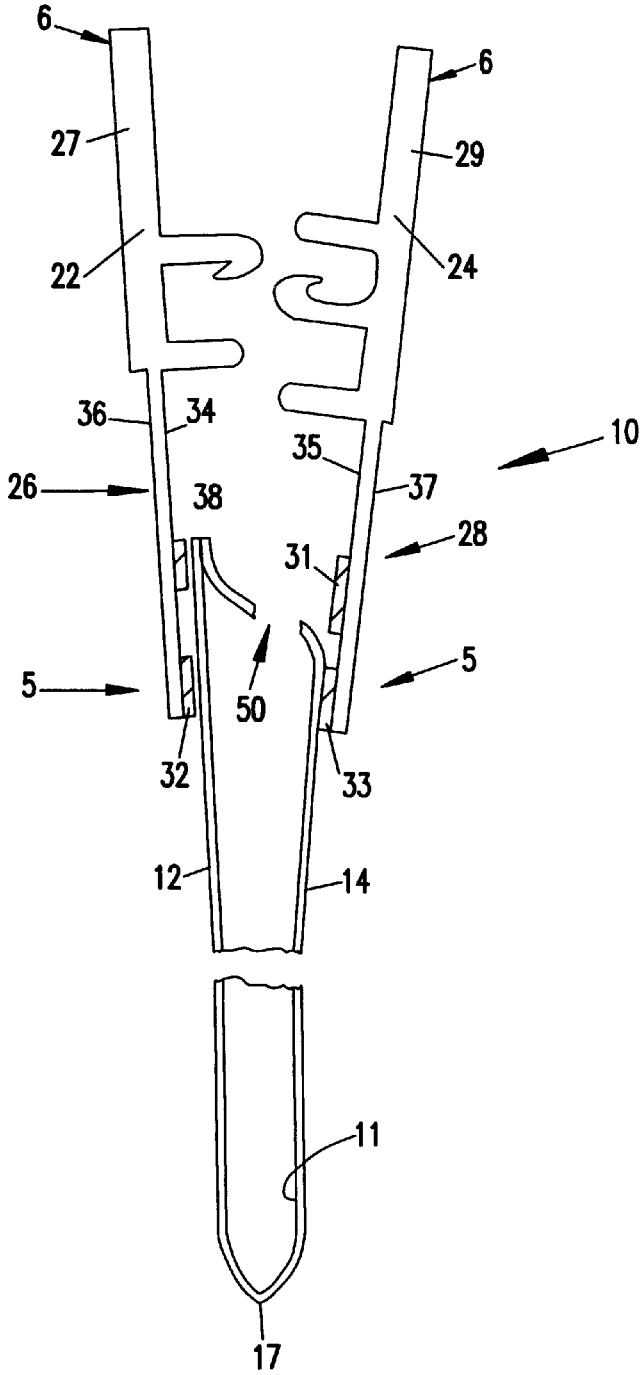
FIG. 3*b* is a schematic, cross-sectional view of a second embodiment of a flexible, reclosable package, with the tamper-evident structure breached, analogous to the view of the package of FIG. 2*b;*
Figure 5A:
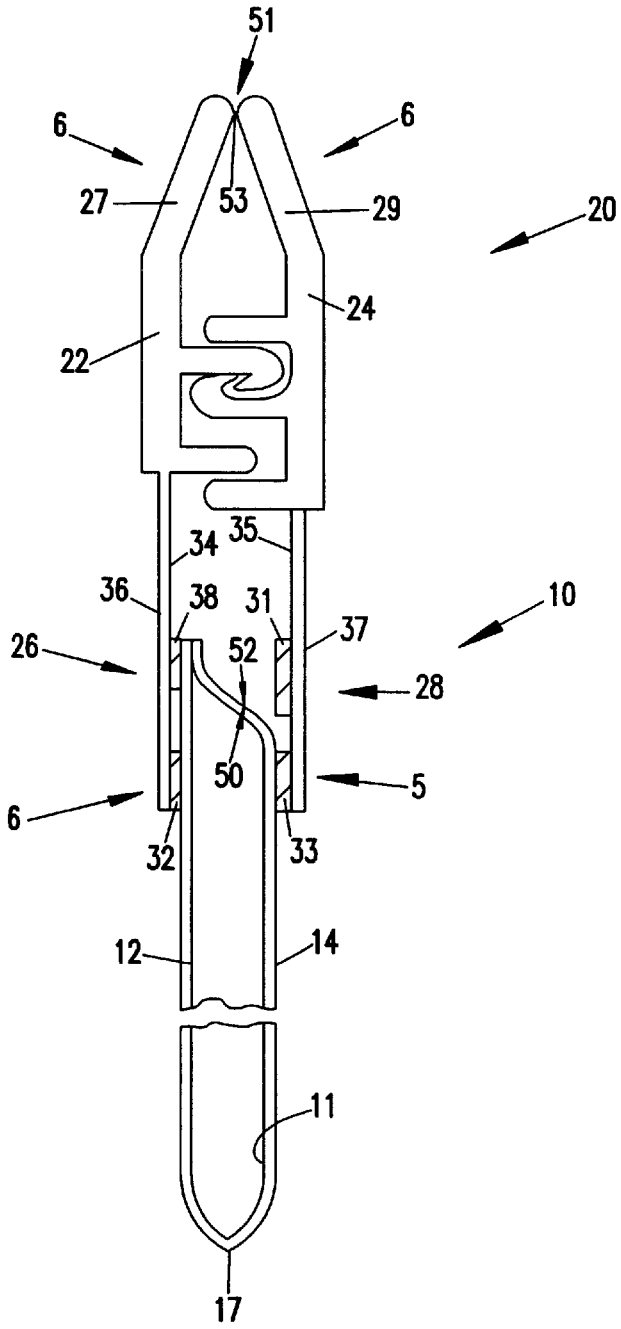
FIG. 5*a* is a schematic, cross-sectional view of a fourth embodiment of a flexible, reclosable package, analogous to the view of the package of FIG. 2*a;*

In contrast, FIGS. 3*a* and 5*a* have a first side panel 12 that extends to the top of the third sealing layer 38. This embodiment is useful for applications that require a hermetic seal, among others. Hermetic sealing material can be incorporated in the side panels 12, 14 and completely enclose the contents of the flexible package 10. FIGS. 3*a* and 5*a* show a first sealing layer 32 disposed on the inner surface 34 of the first sealing flange 26. A second sealing layer 33 is disposed on the inner surface 35 of the second sealing flange 28. A third sealing layer 38 is disposed on the inner surface 34 of the first sealing flange 26. The third sealing layer 38 can be spaced apart from the first sealing layer 32 and between the first sealing layer 32 and the main body of the first closure profile 22. A non-sealing layer 31 may be disposed on the inner surface 35 of the second closure sealing flange 28. The non-sealing layer 31 is preferably located directly opposite from the third sealing layer 38. A first side panel 12 of the flexible package 10 is attached to the first sealing layer 32 and the third sealing layer 38. A second side panel 14 of the flexible package 10 is attached to the second sealing layer 33 and the first side panel 12. The second side panel 14 extends between and is attached to the first and second sealing flange 26, 28. A tear region is located between the first and second sealing flange 26, 28 and is detailed below.

Figure 4A:
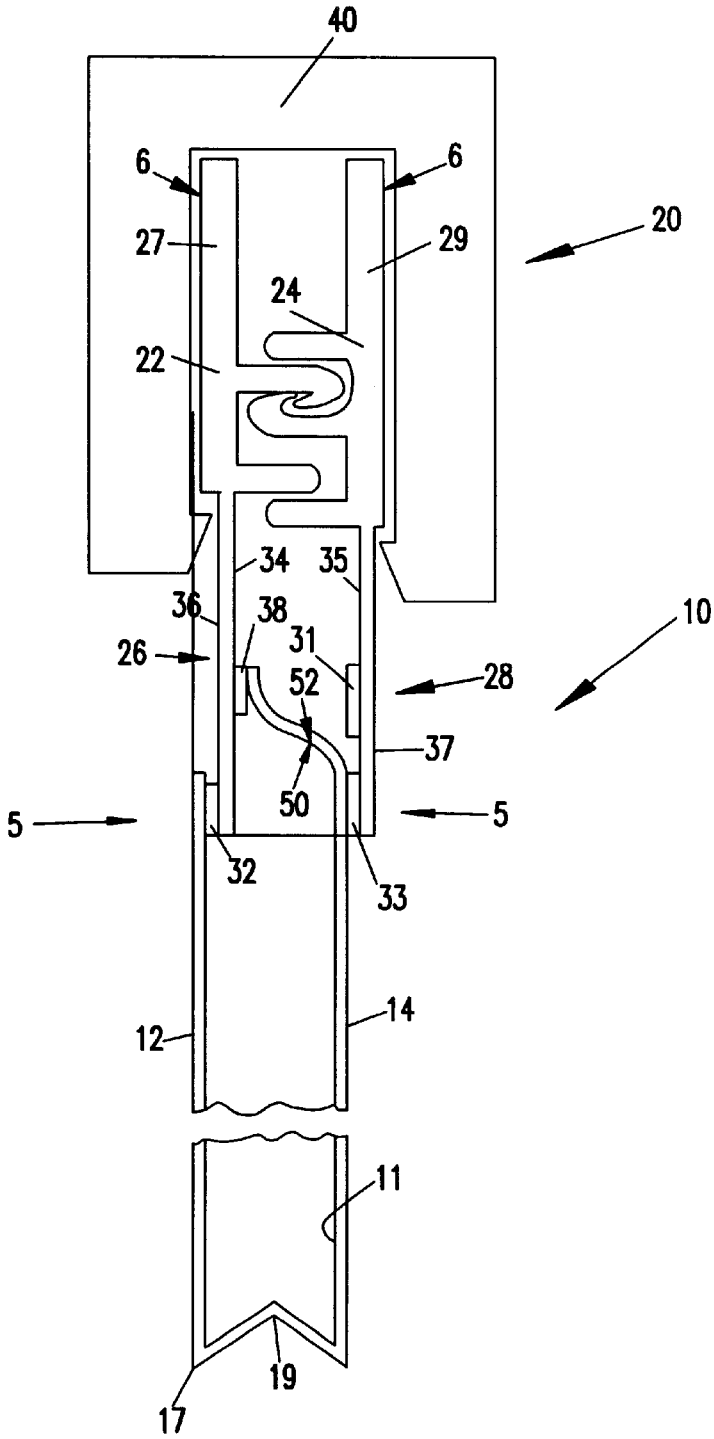
FIG. 4*a* is a schematic, cross-sectional view of a third embodiment of a flexible, reclosable package, analogous to the view of the package of FIG. 2*a;*
Figure 4B:
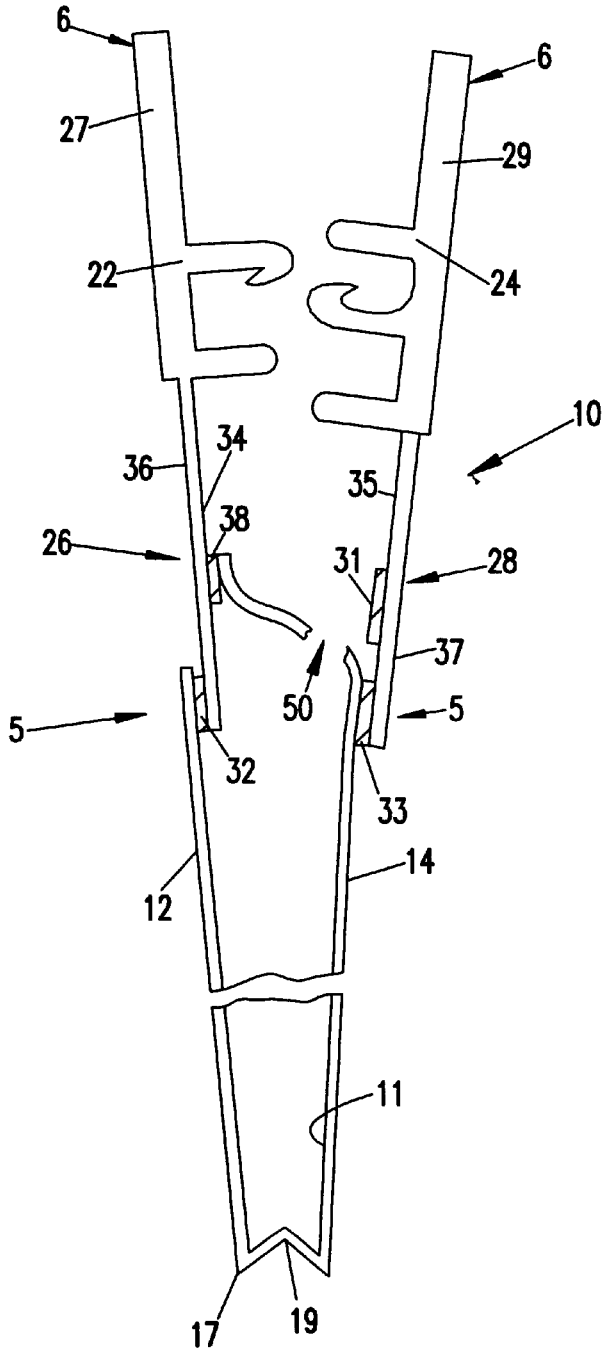
FIG. 4*b* is a schematic, cross-sectional view of a second embodiment of a flexible, reclosable package, with the tamper-evident structure breached, analogous to the view of the package of FIG. 2*b;*

Another non-hermetic embodiment is illustrated as FIG. 4*a*. FIG. 4*a* shows a first sealing layer 32 disposed on the outer surface 36 of the first sealing flange 26. A second sealing layer 33 is disposed on the inner surface 35 of the second sealing flange 28. A third sealing layer 38 is disposed on the inner surface 34 of the first sealing flange 26. The third sealing layer 38 can be offset from the first sealing layer 32 and between the first sealing layer 32 and the main body of the first closure profile 22. A non-sealing layer 31 may be disposed on the inner surface 35 of the second closure sealing flange 28. The non-sealing layer 31 is preferably located directly opposite from the third sealing layer 38. A first side panel 12 of the flexible package 10 is attached to the first sealing layer 32. A second side panel 14 of the flexible package 10 is attached to the second sealing layer 33 and the third sealing layer 38. The second side panel 14 extends between and is attached to the first and second sealing flange 26, 28. A tear region is located between the first and second sealing flange 26, 28 and is detailed below.

FIG. 5*a* shows a web arrangement 51 that extends between the distal ends 6 of the first and second closure profiles 22, 24. Details of the web arrangement 51 are discussed below. FIG. 2*a* and FIG. 3*a* show the zipper closure 20 with a slider device 40 mounted on the zipper closure 20. The slider device 40 is provided to open and close the zipper closure 20. Preferably the slider device 40 is a one-piece unitary, molded plastic member with no movable parts.

The first, second, and third sealing layers 32, 33, 38 bond readily to other materials at temperatures below the melt temperature of the sealing flanges 26, 28. The sealing layers 32, 33, 38 are preferably a mixture of low density polyethylene and ethylene vinyl acetate. This mixture allows the sealant material to seal at lower temperatures than low density polyethylene by providing the sealant material with a melting point ranging preferably from 90° C. to 115° C.

The first and second sealing layers 32, 33 can be directly opposite of each other or can be offset. For instance, the first sealing layer 32 can be located at a point lower on the first sealing flange 26 than the second sealing layer 33 on the second sealing flange 28, or vice versa. The sealing layers 32, 33 may also have widths that are dissimilar. The third sealing layer 38 is offset from the second sealing layer 33. Offset sealing layers allow sealing heat to be offset relative to each side. Thus, the sealing flanges inner surfaces 34, 35 may not reach a temperature sufficient to bond the inner surfaces 34, 35 together.

A non-sealing layer 31 may be disposed on the inner surface 35 of the second closure profile sealing flange 28. Preferably, the non-sealing layer 31 is located directly opposite the third sealing layer 38.

The non-sealing layer 31 does not bond readily to other materials. The non-sealing layer 31 is composed of a heat resistant (or insulating) material. Non-sealing layer 31 ensures that the inner surfaces of the sealing flanges 34, 35 do not bond together during the heat sealing process of attaching the polymeric side panels 12, 14 to the first and second sealing layers 32, 33. The non-sealing layer 31 and the first, second, and third sealing layers 32, 33, 38 can be co-extruded together with the closure profile 20.

Another approach to prevent inner surface 34, 35 bonding is to increase sealing flange 26, 28 thickness. A thicker sealing flange 26, 28 will prevent the inner surface 34, 35 from obtaining a temperature high enough to allow the inner surfaces 34, 35 of the sealing flanges 26, 28 from bonding with each other.

Tamper Evident Structure

Package 10 includes at least one, and in some arrangements, more than one, tamper-evident structures 50, 51 positioned between or joining first and second closure profiles 22, 24. By "tamper-evident", it is meant that it provides an indication to the consumer as to whether package 10 has been previously opened. In order to access the interior 11 of the package 10, the tamper-evident structure 50 needs to be penetrated. In other words, tamper-evident structure 50 acts as a barrier to and blocks access to the package interior 11. Tamper-evident structure 50 is considered an "internal" tamper-evident structure because it is positioned between zipper closure 20 and package interior 11. Tamper-evident structure 51 is considered an "external" tamper-evident structure because it is positioned between zipper closure 20 and package exterior. Tamper-evident structure 51 acts as a barrier and blocks access to the zipper closure 20.

For package 10 in FIG. 2*a* to FIG. 5*b*, the particular tamper-evident structure 50 illustrated is the second side panel 14 attached to the inner surfaces 34, 35 of the sealing flanges 26, 28 forming an internal web or membrane structure or arrangement 50. This tamper-evident structure 50 includes a tear region 52 located between sealing flanges 26, 28 of first and second closure profiles 22, 24. For embodiments with an external tamper-evident structure 51 where the tamper-evident structure is a web member 51 (see FIG. 5*a*), the web member 51 and distal flanges 27, 29 may have a discernable boundary where the distal flanges 27, 29 and web member 51 interface.

A preferred tamper-evident structure 50, 51 is a tear region 52, 53 of preferential weakness. This tear region 52, 53 may take the form of a perforated line, score line, micro-cut, or thinned line relative to the thickness of the portions remaining following penetration of the tear region 52, 53.

The external tamper-evident structure 51 may be similar to the tamper-evident structure 50 or may take the form of a web arrangement 51 joining the first closure profile 22 and the second closure profile 24. This web arrangement 51 may include a plurality of tear regions 53 spaced across the web arrangement 51. By "spaced", it is meant that the tear regions are located intermittently along the web arrangement 51, spaced a distance apart from one another and between the distal flanges. Each tear region has a lower shear strength than the remaining portions following penetration of the web arrangement 51. By "shear strength", it is meant the degree of force applied tangentially on a section on which the action is performed. The action of this force causes, or tends to cause, two contiguous parts of the web arrangement 51 to slide relative to each other in a direction parallel to their plane of contact. The lower shear strength of the tear regions relative to the remaining portions allow for penetration of the internal and external tamper-evident structures 50, 51 and provides a visual indication that the integrity of the flexible package has been compromised.

The tear regions 52, 53 may include a material different than the material of the remaining portions of the web arrangement 51 and second side panel 14. The tear regions 52, 53 may include a material similar to, but thinner than, the material of the remaining portions of the web arrangement 51 and second side panel 14. Either embodiment provides tear regions 52, 53 with a shear strength less than the shear strength of the remaining portions of the web arrangement 51 and second side panel 14.

The tear region 52, 53 may include a material different than the remaining portions of the web arrangement 50, 51. The material of the remaining portions can be the same material used to make the first and second closure profiles 22, 24. The tear region 52, 53 material can be co-extruded with the closure profile from either a flat or a tube extrusion die.

Preferably, the material of the remaining portions of the web arrangement 50, 51 is a polymer selected from the group consisting of low density polyethylene, linear low density polyethylene, ethylene vinyl acetate and mixtures thereof. Preferably, the material of the tear regions 52, 53 is a polymer selected from the group consisting of polypropylene, polybutylene, polyester nylon, high molecular weight high density polyethylene, high density polyethylene and mixtures thereof.

The first and second side panels 12, 14 may have a plurality of layers depending on the desired film barrier properties. With a plurality of layers preferably has two layers of different material but may have three or more layers of different material depending on the desired application. One layer may function as a hermetic barrier layer made from a material such as nylon or Saran®, for example.

The tear region 52 may have a thickness less than the thickness of the second side panel 14. Preferably, the tear region 52 has a thickness ratio of tear region 52 to remaining portions of second side panel 14 of about 1:1.5 to 1:10 and preferably about 1:2 to 1:5. The thickness of the tear region 52 can be about 0.5 to 2 mil thick. The thickness of the second side panel 14 can be about 4 to 10 mil thick. External tamper-evident structures 51 may have a single tear region 53 where portions of the tear region 54 have a thickness less than the remaining portions.

Referring again to FIG. 1, FIG. 2*a*, and FIG. 3*a*, there is an optional slider device 40 mounted on zipper closure 20 to facilitate opening and closing zipper closure 20. Slider devices 40 and how they function to open and close zipper closures, in general, are taught, for example, in U.S. Pat. Nos. 5,063,644; 5,301,394; and 5,442,837, each of which is incorporated by reference herein. A preferred slider device 40 is taught in U.S. patent applications Ser. Nos. 09/365,215 and 29/108,657, both filed Jul. 30, 1999, and incorporated herein by reference in their entirety. A notch 42 is disposed within zipper closure 20 adjacent to a second edge 15 in package 10. Notch 42 is designed to provide a "park place" into which slider device 40 settles when zipper closure 20 is sealed and slider device 40 is at second edge 15. Such a notch 42 may decrease any tendency for an incomplete interlock between first closure profile 22 and second closure profile 24.

Methods of Use

In order to open the reclosable flexible package 10 using the embodiments of FIGS. 2*a* and 2*b*, 3*a* and 3*b*, 4*a* and 4*b*, the consumer grips the first closure profile 22 and the second closure profile 24 and pulls the first closure profile 22 and the second closure profile 24 apart such that the closure profiles 22, 24 disengage from one another and expose web arrangement 52. The second side panel 14 extends between the first and second sealing flange 26, 28 and blocks access to the package interior 11. Next, the consumer penetrates the tear region 52 . The flexible package 10 can be resealed utilizing the reclosable zipper closure 20. Specifically, the consumer grips first and second closure profiles 22, 24 and moves it from the open position to the closed position so as to engage the complimentary closure profiles 22, 24. Optionally, a slider device 40 mounted on zipper closure 20 facilitates the opening and closing of the zipper closure 20 as the slider device 40 moves from a first position to a second position along the zipper closure 20.

Figure 5B:
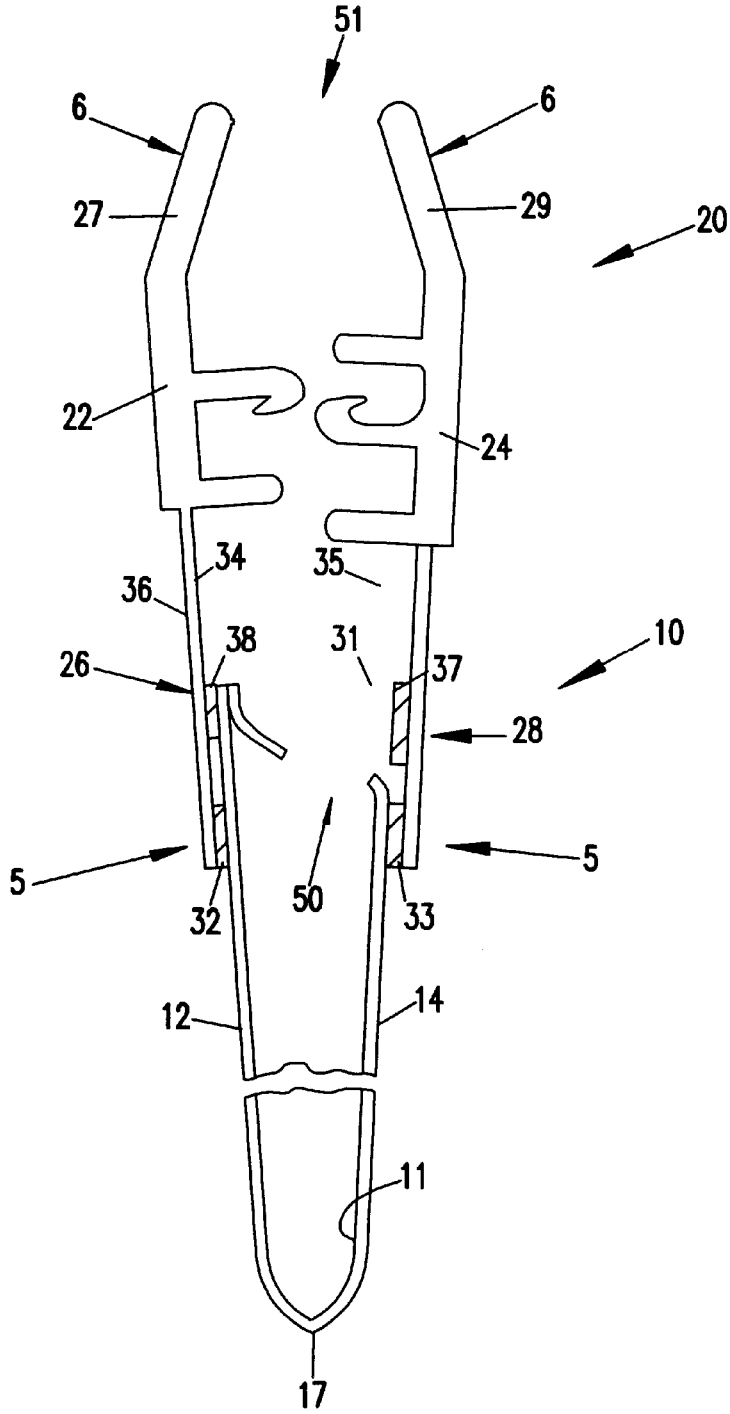
FIG. 5*b* is a schematic, cross-sectional view of a second embodiment of a flexible, reclosable package, with the tamper-evident structure breached, analogous to the view of the package of FIG. 2*b.*

In embodiments such as one depicted in FIG. 5*a* and 5*b*, where the first and second closure profiles 22, 24 include second web arrangement 53, the consumer penetrates the second web arrangement 53 prior to or during the action of disengaging the first and second closure profiles 22, 24. Optionally, a slider device 40 mounted on zipper closure 20 facilitates the penetration of the second web member 53 as the slider device 40 moves from a first position to a second position along the zipper closure 20. After the second web arrangement 53 is broken, the first and second closure profiles 22, 24 are disengaged, and the first web arrangement 52 is exposed and broken, as described above. FIGS. 2*b*, 3*b*, 4*b*, and 5*b* illustrate the reclosable packages with tamper-evident structures that have been breached.

Methods of Manufacture

To construct the reclosable package 10 with a slider device 40, the package 10 may be formed by either a blown extrusion process or by using a preformed roll of film. The film is folded in the form shown in FIG. 1. The zipper closure 20 has a first closure profile 22 and a second closure profile 24. The first closure profile 22 may be applied to a first side panel 12 of the flexible bag. The second side panel 14 may be applied to both the first closure profile 22 and the second closure profile 24 providing a tamper evident structure 50. A slider device 40 may optionally be mounted onto the zipper closure 20 to provide a reclosable package 10. The slider device 40 is constructed and arranged for interlocking the first closure profile 22 with the second closure profile 24 when the slider device 40 is moved in a first direction. The slider device 40 is constructed and arranged for disengaging the first closure profile 22 from the second closure profile 24 when the slider 40 is moved in a second opposite direction.

The above specification is believed to provide a complete description of the manufacture and use of particular embodiments of the invention. Many embodiments of the invention can be made without departing from the spirit and scope of the invention.

What is claimed:

1. A flexible package comprising:

(a) a package surrounding wall defining a package interior and having a mouth; the mouth providing access to the package interior; the surrounding wall includes a first side panel and a second side panel opposite the first side panel;

(b) a reclosable zipper along the mouth for selective opening and closing of the mouth; the zipper including:

(i) a first closure profile;

(A) the first closure profile having a sealing flange located at a first end of the first closure profile and a distal flange located at a second end of the first closure profile;

(B) the sealing flange of the first closure profile having an inner and outer surface;

(ii) a second closure profile;

(A) the second closure profile having a scaling flange located at a first end of the second closure profile and a distal flange located at a second end of the second closure profile;

(B) the sealing flange of the second closure profile having an inner and outer surface;

(iii) the second side panel extending between the sealing flanges of the first closure profile and the second closure profile; the second side panel including a tear region located between the first closure profile and the second closure profile; the tear region having a lower shear strength than remaining portions of the second side panel;

(c) a first sealing layer disposed on the inner surface of the first closure profile sealing flange;

(d) a second sealing layer disposed on the inner surface of the second closure profile sealing flange;

(e) a third sealing layer disposed on the inner surface of the first closure profile sealing flange; and (f) a non-sealing layer disposed on the inner surface of the second closure profile scaling flange opposite the third sealing layer.

2. A flexible package according to claim 1, herein the tear region has a thickness less than the remaining portions of the second side panel.

3. A flexible package according to claim 1, wherein the thickness of the tear region to the thickness of the remaining portions of the second side panel ratio is about 1:1.5 to 1:10.

4. A flexible package according to claim 1, wherein the first side panel is disposed on the first and third sealing layers, and the second side panel is disposed on the first side panel opposite the non-sealing layer.

5. A flexible package according to claim 1, wherein a web arrangement extends between the distal flanges of the first closure profile and the second closure profile.

6. A flexible package according to claim 1, further comprising a slider device operably mounted onto the reclosable zipper, the slider device being constructed and arranged for interlocking the first closure profile with the second closure profile when the slider device is moved in a first direction, and for disengaging the first closure profile from the second closure profile when the slider device is moved in a second opposite direction.

7. A flexible package comprising:

(a) a package surrounding wall defining a package interior and having a mouth; the mouth providing access to the package interior; the surrounding wall includes a first side panel and a second side panel opposite the first side panel;

(b) a reclosable zipper along the mouth for selective opening and closing of the mouth; the zipper including:

(i) a first closure profile;

(A) the first closure profile having a scaling flange located at a first end of the first closure profile and a distal flange located at a second end of the first closure profile;

(B) the sealing flange of the first closure profile having an inner and outer surface;

(ii) a second closure profile;

(A) the second closure profile having a sealing flange located at a first end of the second closure profile and a distal flange located at a second end of the second closure profile;

(B) the sealing flange of the second closure profile having an inner and outer surface;

(iii) the second side panel extending between the sealing flanges of the first closure profile and the second closure profile; the second side panel including a tear region located between the first closure profile and the second closure profile, the tear region having a lower shear strength than remaining portions of the second side panel;

(c) a first sealing layer disposed on the outer surface of the first closure profile sealing flange;

(d) a second sealing layer disposed on the inner surface of the second closure profile sealing flange;

(e) a third sealing layer disposed on the inner surface of the first closure profile sealing flange; and (f) a non-sealing layer disposed on the inner surface of the second closure profile sealing flange opposite the third scaling layer.

8. A flexible package according to claim 7, wherein the tear region has a thickness less than the remaining portions of the second side panel.

9. A flexible package according to claim 7, wherein the thickness of the tear region to the thickness of the remaining portions of the second side panel ratio is about 1:1.5 to 1:10.

10. A flexible package according to claim 7, wherein a web arrangement extends between the distal flanges of the first closure profile and the second closure profile.

11. A flexible package according to claim 7, further comprising a slider device operably mounted onto the reclosable zipper, the slider device being constructed and arranged for interlocking the first closure profile with the second closure profile when the slider device is moved in a first direction, and for disengaging the first closure profile from the second closure profile when the slider device is moved in a second opposite direction.

12. A flexible package comprising:

(a) a package surrounding wall defining a package interior and having a mouth; the mouth providing access to the package interior; the surrounding wall includes a first side panel and a second side panel opposite the first side panel;

(b) a reclosable zipper along the mouth for selective opening and closing of the mouth; the zipper including:

(i) a first closure profile;

(A) the first closure profile having a sealing flange located at a first end of the first closure profile and a distal flange located at a second end of the first closure profile;

(B) the sealing flange of the first closure profile having an inner and outer surface;

(ii) a second closure profile;

(A) the second closure profile having a sealing flange located at a first end of the second closure profile and a distal flange located at a second end of the second closure profile;

(B) the sealing flange of the second closure profile having an inner and outer surface;

(iii) the second side panel extending between the sealing flanges of the first closure profile and the second closure profile; the second side panel including a tear region located between the first closure profile and the second closure profile;

(c) a second closure profile sealing layer disposed on the inner surface of the second closure profile sealing flange;

(d) a first closure profile sealing layer disposed on the inner surface of the first closure profile sealing flange; and (f) a non-sealing layer disposed on the inner surface of the second closure profile sealing flange opposite the first closure profile sealing layer.

13. A flexible package according to claim 12, wherein the tear region has a thickness less than the remaining portions of the second side panel.

14. A flexible package according to claim 12, wherein the thickness of the tear region to the thickness of the remaining portions of the second side panel ratio is about 1:1.5 to 1:10.

15. A flexible package according to claim 12 further comprising:

(a) an additional first closure profile scaling layer disposed on one of the outer surface and inner surface of the first closure profile sealing flange.

16. A flexible package according to claim 12, further comprising a slider device operably mounted onto the reclosable zipper, the slider device being constructed and arranged for interlocking the first closure profile with the second closure profile when the slider device is moved in a first direction, and for disengaging the first closure profile from the second closure profile when the slider device is moved in a second opposite direction.

17. A method of using a reclosable package comprising steps of:

(a) providing a package with an interior defined by a first side panel and a second side panel opposite the first side panel and having a reclosable mouth and a reclosable zipper arrangement for opening and closing the mouth; the zipper arrangement including:

a first closure profile and a second closure profile; the first closure profile having a scaling flange located at a first end of the first closure profile and a distal flange located at a second end of the first closure profile; the second closure profile having a sealing flange located at a first end of the second closure profile and a distal flange located at a second end of the second closure profile; the second side panel extending between the first and second closure profiles blocking access to the package interior; the second side panel extending between the first and second closure profiles including a tear region between the first and second closure profiles; the tear region having lower shear strength than remaining portions of the second side panel; a second closure profile sealing layer disposed on an inner surface of the second closure profile sealing flange; a first closure profile sealing layer disposed on an inner surface of the first closure profile sealing flange; a non-sealing layer disposed on the inner surface of the second closure profile sealing flange opposite the first closure profile sealing layer; and (b) penetrating the tear region.

18. A method according to claim 17 wherein the step of providing a package includes providing a package having a web arrangement extending between the first and second distal end of the first and second closure profiles, and further including a step of:

(a) before the step of penetrating the tear region, penetrating the web arrangement to unlock the reclosable zipper and open the mouth.

19. A method of manufacturing a reclosable package; the method comprising:

(a) providing a zipper closure having a first closure profile and a second closure profile; the first closure profile and the second closure profile each having a sealing flange; the first closure profile and the second closure profile having selectively interlocking closure members;

(b) attaching an inner surface of the first closure profile sealing flange to a first side panel to form a first attachment area;

(c) attaching an inner surface of the second closure profile sealing flange to a second side panel;

(d) attaching the inner surface of the first closure profile sealing flange to the second side panel to form a second attachment area;

(i) the second attachment area being between the first attachment area and the interlocking closure members;

(ii) the second side panel extending between the first closure profile scaling flange and the second closure profile sealing flange to form a tamper-evident web;

(d) disposing a non-sealing layer on the inner surface of the second closure profile sealing flange opposite to the second attachment area of the first closure profile sealing flange; and (d) operably mounting a slider device onto the zipper closure to provide the reclosable package, the slider device constructed and arranged for selectively interlocking the first closure profile members with the second closure profile members when the slider device is moved in a first direction, and for selectively disengaging the first closure profile members from the second closure profile members when the slider device is moved in a second opposite direction.

* * * * *

UNITED STATES PATENT AND TRADEMARK OFFICE

CERTIFICATE OF CORRECTION

PATENT NO. : 6,386,760 B1
DATED : May 14, 2002
INVENTOR(S) : Mladomir Tomic

It is certified that error appears in the above-identified patent and that said Letters Patent is hereby corrected as shown below:

Column 8,
Line 36, “herein” should read -- wherein --.

Column 10,
Line 43, “scaling” should read -- sealing --.

Column 12,
Line 5, “scaling” should read -- sealing --.

Signed and Sealed this

Eighth Day of July, 2003

JAMES E. ROGAN
*Director of the United States Patent and Trademark Office*